US005935415A

United States Patent [19]

Haizmann et al.

[11] Patent Number: 5,935,415

[45] **Date of Patent: *Aug. 10, 1999**

[54] CONTINUOUS CATALYTIC REFORMING PROCESS WITH DUAL ZONES

[75] Inventors: Robert S. Haizmann, Rolling Meadows; John Y. G. Park, Naperville; Michael B. Russ, Villa Park, all of Ill.

[73] Assignee: UOP LLC, Des Plaines, Ill.

[ * ] Notice: This patent is subject to a terminal disclaimer.

[21] Appl. No.: 08/963,693

[22] Filed: Nov. 4, 1997

Related U.S. Application Data

[63] Continuation-in-part of application No. 08/635,857, Apr. 22, 1996, Pat. No. 5,683,573, which is a continuation-in-part of application No. 08/362,343, Dec. 22, 1994, abandoned.

[51] Int. Cl.[6] ..... C10G 35/06

[52] U.S. Cl. ..... 208/64; 208/63; 208/65

[58] Field of Search ..... 208/64, 63, 65

[56] References Cited

U.S. PATENT DOCUMENTS

| | | | |
|---|---|---|---|
| 3,652,231 | 3/1972 | Greenwood et al. | 23/288 G |
| 3,718,578 | 2/1973 | Buss et al. | 208/139 |
| 3,873,441 | 3/1975 | Jones | 208/166 |
| 4,125,454 | 11/1978 | Clem et al. | 208/65 |
| 4,208,397 | 6/1980 | Coates | 423/651 |
| 4,645,586 | 2/1987 | Buss | 208/65 |
| 4,985,132 | 1/1991 | Moser et al. | 208/65 |
| 5,190,638 | 3/1993 | Swan, III et al. | 208/65 |
| 5,683,573 | 11/1997 | Haizmann et al. | 208/64 |

*Primary Examiner*—Helane Myers

*Attorney, Agent, or Firm*—Thomas K. McBride; John F. Spears, Jr.; Richard E. Conser

[57] ABSTRACT

A hydrocarbon feedstock is catalytically reformed in a sequence comprising a continuous-reforming zone, consisting essentially of a moving-bed catalytic reforming zone and continuous regeneration of catalyst particles, and a zeolitic-reforming zone containing a catalyst comprising a platinum-group metal and a nonacidic zeolite. The process combination permits higher severity, higher aromatics yields and/or increased throughput in the continuous-reforming zone, thus showing surprising benefits over prior-art processes, and is particularly useful in upgrading existing moving-bed reforming facilities with continuous catalyst regeneration.

15 Claims, 2 Drawing Sheets

CONTINUOUS CATALYTIC REFORMING PROCESS WITH DUAL ZONES

CROSS REFERENCE TO RELATED APPLICATIONS

This application is a continuation-in-part of prior application Ser. No. 08/635,857, filed Apr. 22, 1996, U.S. Pat. No. 5,683,573, which is a continuation-in-part of prior application Ser. No. 08/362,343, filed Dec. 22, 1994, abandoned Apr. 18, 1996.

BACKGROUND OF THE INVENTION

1. Field of the Invention

This invention relates to an improved process for the conversion of hydrocarbons, and more specifically for the catalytic reforming of gasoline-range hydrocarbons.

2. General Background

Continuous catalytic reforming, using a moving bed of catalyst to effect reforming and continuously regenerating the moving bed of catalyst to avoid its deactivation, has dominated new reforming-unit construction in recent years. The catalytic reforming of hydrocarbon feedstocks in the gasoline range is practiced in nearly every significant petroleum refinery in the world to produce aromatic intermediates for the petro- chemical industry or gasoline components with high resistance to engine knock. Demand for aromatics is growing more rapidly than the supply of feedstocks for aromatics production. Moreover, increased gasoline upgrading necessitated by environmental restrictions and the rising demands of high-performance internal-combustion engines are increasing the required knock resistance of the gasoline component as measured by gasoline "octane" number. A catalytic reforming unit within a given refinery, therefore, often must be upgraded in capability in order to meet these increasing aromatics and gasoline-octane needs. Such upgrading as applied to a continuous catalytic reforming process desirably would make efficient use of the existing reforming and catalyst-regeneration equipment.

Catalytic reforming generally is applied to a feedstock rich in paraffinic and naphthenic hydrocarbons and is effected through diverse reactions: dehydrogenation of naphthenes to aromatics, dehydrocyclization of paraffins, isomerization of paraffins and naphthenes, dealkylation of alkylaromatics, hydrocracking of paraffins to light hydrocarbons, and formation of coke which is deposited on the catalyst. Increased aromatics and gasoline-octane needs have turned attention to the paraffin-dehydrocyclization reaction, which is less favored thermodynamically and kinetically in conventional reforming than other aromatization reactions. Considerable leverage exists for increasing desired product yields from catalytic reforming by promoting the dehydrocyclization reaction over the competing hydrocracking reaction while minimizing the formation of coke. Continuous catalytic reforming, which can operate at relatively low pressures with high-activity catalyst by continuously regenerating catalyst, is effective for dehydrocyclization.

The effectiveness of reforming catalysts comprising a non-acidic L-zeolite and a platinum-group metal for dehydrocyclization of paraffins is well known in the art. The use of these reforming catalysts to produce aromatics from paraffinic raffinates as well as naphthas has been disclosed. Nevertheless, this dehydrocyclization technology has been slow to be commercialized during the intense and lengthy development period. The present invention represents a novel approach to the complementary use of L-zeolite technology.

U.S. Pat. No. 4,645,586 (Buss) teaches contacting a feed with a bifunctional reforming catalyst comprising a metallic oxide support and a Group VIII metal followed by a zeolitic reforming catalyst comprising a large-pore zeolite which preferably is zeolite L. The deficiencies of the prior art are overcome by using the first conventional reforming catalyst to provide a product stream to the second, non-acidic, high-selectivity catalyst. There is no suggestion of continuous reforming in Buss, however.

U.S. Pat. No. 4,985,132 (Moser et al.) teaches a multizone catalytic reforming process, with the catalyst of the initial zone containing platinum-germanium on a refractory inorganic oxide and the terminal catalyst zone being a moving-bed system with associated continuous catalyst regeneration. However, there is no disclosure of an L-zeolite component.

U.S. Pat. No. 5,190,638 (Swan et al.) teaches reforming in a moving-bed continuous-catalyst-regeneration mode to produce a partially reformed stream to a second reforming zone preferably using a catalyst having acid functionality at 100–500 psig, but does not disclose the use of a nonacidic zeolitic catalyst.

U.S. Pat. No. 3,652,231 (Greenwood et al.) teaches regeneration and reconditioning of a reforming catalyst in a moving column, but does not suggest two zones of reforming.

SUMMARY OF THE INVENTION

It is an object of the present invention to provide a catalytic reforming process which effects an improved product yield structure. A corollary objective is to improve aromatics yields and performance of a continuous reforming process.

This invention is based on the discovery that a combination of continuous catalytic reforming and zeolitic reforming shows surprising improvements in aromatics yields and process utilization relative to the prior art.

A broad embodiment of the present invention is a catalytic reforming process combination in which a hydrocarbon feedstock is processed successively by continuous catalytic reforming, comprising a moving bed with continuous catalyst regeneration, and in a zeolitic-reforming zone containing a catalyst which comprises a nonacidic zeolite and a platinum-group metal. Continuous reforming preferably is effected using a catalyst comprising a refractory inorganic-oxide support, platinum-group metal and halogen, which is at least semicontinuously regenerated and reconditioned and returned to the continuous-reforming reactor. The nonacidic zeolite preferably is an L-zeolite, most preferably potassium-form L-zeolite. The preferred platinum-group metal for one or both of the continuous and zeolitic reforming catalysts is platinum.

A first effluent from continuous catalytic reforming optimally is processed in the zeolitic reforming zone without separation of free hydrogen.

In another aspect, the invention comprises adding a zeolitic reforming zone to expand the throughput and/or enhance product quality of an existing continuous-reforming process unit.

These as well as other objects and embodiments will become apparent from the detailed description of the invention.

DESCRIPTION OF THE PREFERRED EMBODIMENTS

Figure 1:
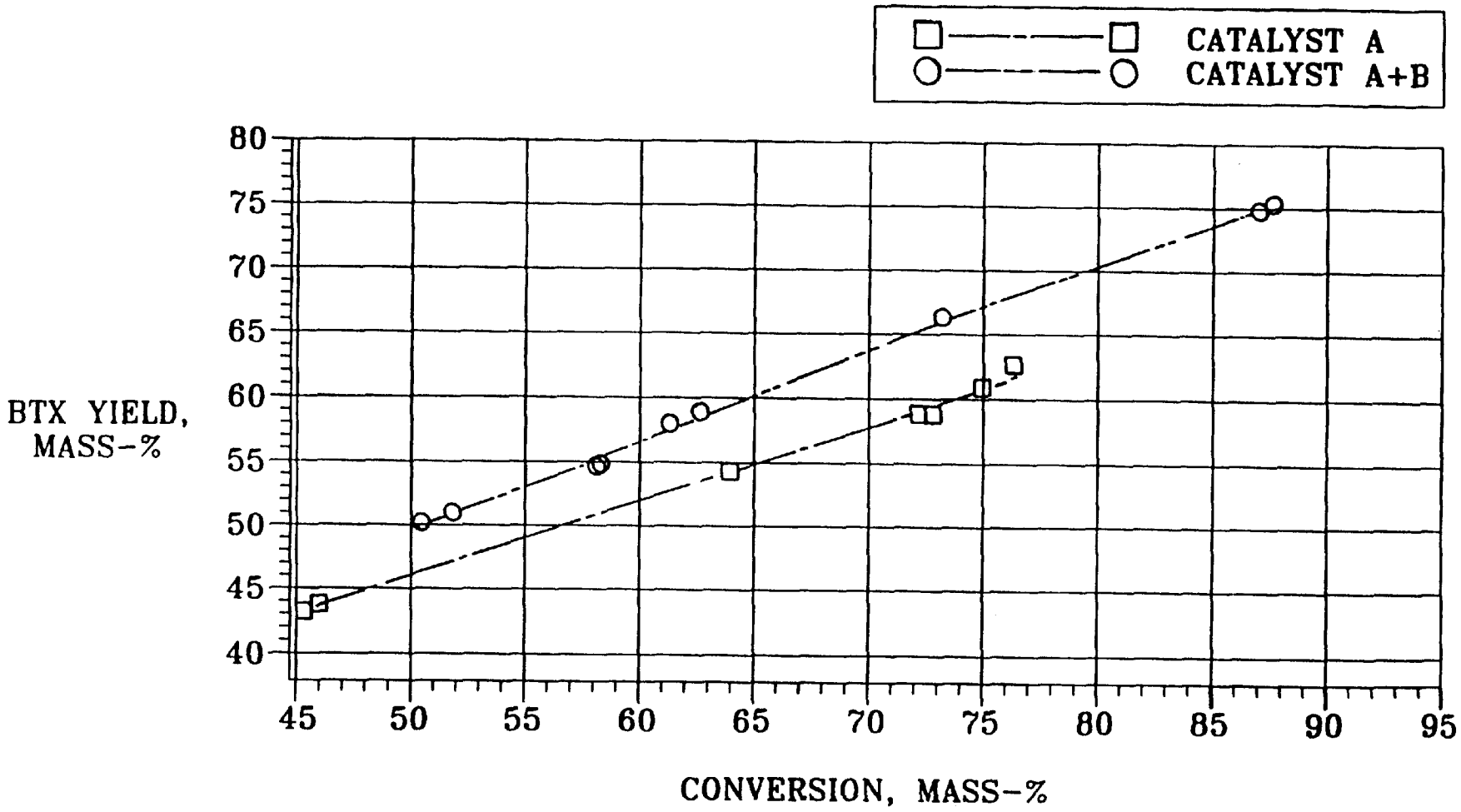
FIG. 1 shows BTX-aromatics yields for the process combination of the invention in comparison to yields based on the known art.

To reiterate, a broad embodiment of the present invention is directed to a catalytic reforming process combination in which a hydrocarbon feedstock is processed successively by continuous catalytic reforming, comprising a moving bed with continuous catalyst regeneration, and in a zeolitic-reforming zone containing a catalyst which comprises a nonacidic zeolite and a platinum-group metal. An embodiment of the invention comprises adding a zeolitic reforming zone to expand the capability of an existing continuous-reforming process unit.

The hydrocarbon feedstock comprises paraffins and naphthenes, and may comprise aromatics and small amounts of olefins, boiling within the gasoline range. Feedstocks which may be utilized include straight-run naphthas, natural gasoline, synthetic naphthas, thermal gasoline, catalytically cracked gasoline, partially reformed naphthas or raffinates from extraction of aromatics. The distillation range may be that of a full-range naphtha, having an initial boiling point typically from 40°–80° C. and a final boiling point of from about 160°–210° C., or it may represent a narrower range with a lower final boiling point. Paraffinic feedstocks, such as naphthas from Middle East crudes having a final boiling point within the range of about 100°–175° C., are advantageously processed since the process effectively dehydrocyclizes paraffins to aromatics. Raffinates from aromatics extraction, containing principally low-value $C_6$–$C_8$ paraffins which can be converted to valuable B-T-X aromatics, are favorable alternative hydrocarbon feedstocks.

The hydrocarbon feedstock to the present process contains small amounts of sulfur compounds, amounting to generally less than 10 mass parts per million (ppm) on an elemental basis. Preferably the hydrocarbon feedstock has been prepared from a contaminated feedstock by a conventional pretreating step such as hydrotreating, hydrorefining or hydrodesufurization to convert such contaminants as sulfurous, nitrogenous and oxygenated compounds to $H_2S$, $NH_3$ and $H_2O$, respectively, which can be separated from the hydrocarbons by fractionation. This conversion preferably will employ a catalyst known to the art comprising an inorganic oxide support and metals selected from Groups VIB(6) and VIII(9–10) of the Periodic Table. [See Cotton and Wilkinson, *Advanced Inorganic Chemistry*, John Wiley & Sons (Fifth Edition, 1988)]. Alternatively or in addition to the conventional hydrotreating, the pretreating step may comprise contact with sorbents capable of removing sulfurous and other contaminants. These sorbents may include but are not limited to zinc oxide, iron sponge, high-surface-area sodium, high-surface-area alumina, activated carbons and molecular sieves; excellent results are obtained with a nickel-on-alumina sorbent. Preferably, the pretreating step will provide the zeolitic reforming catalyst with a hydrocarbon feedstock having low sulfur levels disclosed in the prior art as desirable reforming feedstocks, e.g., 1 ppm to 0.1 ppm (100 ppb).

The pretreating step may achieve very low sulfur levels in the hydrocarbon feedstock by combining a relatively sulfur-tolerant reforming catalyst with a sulfur sorbent. The sulfur-tolerant reforming catalyst contacts the contaminated feedstock to convert most of the sulfur compounds to yield an $H_2S$-containing effluent. The $H_2S$-containing effluent contacts the sulfur sorbent, which advantageously is a zinc oxide or manganese oxide, to remove $H_2S$. Sulfur levels well below 0.1 mass ppm may be achieved thereby. It is within the ambit of the present invention that the pretreating step be included in the present reforming process.

Each of the continuous-reforming zone and zeolitic-reforming zone contains one or more reactors containing the respective catalysts. The feedstock may contact the respective catalysts in each of the respective reactors in either upflow, downflow, or radial-flow mode. Since the present reforming process operates at relatively low pressure, the low pressure drop in a radial-flow reactor favors the radial-flow mode.

First reforming conditions comprise a pressure, consistent with the zeolitic reforming zone, of from about 100 kPa to 6 MPa (absolute) and preferably from 100 kPa to 1 MPa (abs). Excellent results have been obtained at operating pressures of about 450 kPa or less. Free hydrogen, usually in a gas containing light hydrocarbons, is combined with the feedstock to obtain a mole ratio of from about 0.1 to 10 moles of hydrogen per mole of $C_5$+ hydrocarbons. Space velocity with respect to the volume of first reforming catalyst is from about 0.2 to 10 $hr^{-1}$. Operating temperature is from about 400° to 560° C.

The continuous-reforming zone produces an aromatics-enriched first effluent stream. Most of the naphthenes in the feedstock are converted to aromatics. Paraffins in the feedstock are primarily isomerized, hydrocracked, and dehydrocyclized, with heavier paraffins being converted to a greater extent than light paraffins with the latter therefore predominating in the effluent. The aromatics content of the $C_5$+ portion of the effluent is increased by at least 5 mass % relative to the aromatics content of the hydrocarbon feedstock. The composition of the aromatics depends principally on the feedstock composition and operating conditions, and generally will consist principally of $C_6$–$C_{12}$ aromatics.

During the reforming reaction, catalyst particles become deactivated as a result of mechanisms such as the deposition of coke on the particles to the point that the catalyst is no longer useful. Such deactivated catalyst must be regenerated and reconditioned before it can be reused in a reforming process.

Continuous reforming permits higher operating severity by maintaining the high catalyst activity of near-fresh catalyst through regeneration cycles of a few days. A moving-bed system has the advantage of maintaining production while the catalyst is removed or replaced. Catalyst particles pass by gravity through one or more reactors in a moving bed and is conveyed to a continuous regeneration zone. Continuous catalyst regeneration generally is effected by passing catalyst particles downwardly by gravity in a moving-bed mode through various treatment zones in a regeneration vessel. Although movement of catalyst through the zones is often designated as continuous in practice it is semi-continuous in the sense that relatively small amounts of catalyst particles are transferred at closely spaced points in time. For example, one batch per minute may be withdrawn from the bottom of a reaction zone and withdrawal may take one-half minute; e.g., catalyst particles flow for one-half minute in the one-minute period. Since the inventory in the reaction and regeneration zones generally is large in relation to the batch size, the catalyst bed may be envisaged as moving continuously.

In a continuous-regeneration zone, catalyst particles are contacted in a combustion zone with a hot oxygen-containing gas stream to remove coke by oxidation. The catalyst usually next passes to a drying zone to remove water by contacting a hot, dry air stream. Dry catalyst is cooled by direct contact with an air stream. Optimally, the catalyst also is halogenated in a halogenation zone located below the combustion zone by contact with a gas containing a halogen component. Finally, catalyst particles are reduced with a hydrogen-containing gas in a reduction zone to obtain reconditioned catalyst particles which are conveyed to the moving-bed reactor. Details of continuous catalyst regeneration, particularly in connection with a moving-bed reforming process, are disclosed below and inter alia in U.S. Pat. Nos. 3,647,680; 3,652,231; 3,692,496; and 4,832,921, all of which are incorporated herein by reference.

Spent catalyst particles from the continuous-reforming zone first are contacted in the regeneration zone with a hot oxygen-containing gas stream in order to remove coke which accumulates on surfaces of the catalyst during the reforming reaction. Coke content of spent catalyst particles may be as much as 20% of the catalyst weight, but 5–7% is a more typical amount. Coke comprises primarily carbon with a relatively small amount of hydrogen, and is oxidized to carbon monoxide, carbon dioxide, and water at temperatures of about 450–550° C. which may reach 600° C. in localized regions. Oxygen for the combustion of coke enters a combustion section of the regeneration zone in a recycle gas containing usually about 0.5 to 1.5% oxygen by volume. Flue gas made up of carbon monoxide, carbon dioxide, water, unreacted oxygen, chlorine, hydrochloric acid, nitrous oxides, sulfur oxides and nitrogen is collected from the combustion section, with a portion being withdrawn from the regeneration zone as flue gas. The remainder is combined with a small amount of oxygen-containing makeup gas, typically air in an amount of roughly 3% of the total gas, to replenish consumed oxygen and returned to the combustion section as recycle gas. The arrangement of a typical combustion section may be seen in U.S. Pat. No. 3,652,231.

As catalyst particles move downward through the combustion section with concomitant removal of coke, a "breakthrough" point is reached typically about halfway through the section where less than all of the oxygen delivered is consumed. It is known in the art that the present reforming catalyst particles have a large surface area associated with a multiplicity of pores. When the catalyst particles reach the breakthrough point in the bed, the coke remaining on the surface of the particles is deep within the pores and therefore the oxidation reaction occurs at a much slower rate.

Water in the makeup gas and from the combustion step is removed in the small amount of vented flue gas, and therefore builds to an equilibrium level in the recycle-gas loop. The water concentration in the recycle loop optionally may be lowered by drying the air that made up the makeup gas, installing a drier for the gas circulating in the recycle gas loop or venting a larger amount of flue gas from the recycle gas stream to lower the water equilibrium in the recycle gas loop.

Optionally, catalyst particles from the combustion zone pass directly into a drying zone wherein water is evaporated from the surface and pores of the particles by contact with a heated gas stream. The gas stream usually is heated to about 425–600° C. and optionally pre-dried before heating to increase the amount of water that can be absorbed. Preferably the drying gas stream contain oxygen, more preferably with an oxygen content about or in excess of that of air, so that any final residual burning of coke from the inner pores of catalyst particles may be accomplished in the drying zone and so that any excess oxygen that is not consumed in the drying zone can pass upwardly with the flue gas from the combustion zone to replace the oxygen that is depleted through the combustion reaction. Contacting the catalyst particles with a gas containing a high concentration of oxygen also aids in restoring full activity to the catalyst particles by raising the oxidation state of the platinum or other metals contained thereon. The drying zone is designed to reduce the moisture content of the catalyst particles to no more than 0.01 weight fraction based on catalyst before the catalyst particles leave the zone.

Following the optional drying step, the catalyst particles preferably are contacted in a separate zone with a chlorine-containing gas to re-disperse the noble metals over the surface of the catalyst. Re-dispersion is needed to reverse the agglomeration of noble metals resulting from exposure to high temperatures and steam in the combustion zone. Redispersion is effected at a temperature of between about 425–600° C., preferably about 510–540°. A concentration of chlorine on the order of 0.01 to 0.2 mol. % of the gas and the presence of oxygen are highly beneficial to promoting rapid and complete redispersion of the platinum-group metal to obtain redispersed catalyst particles.

Regenerated and redispersed catalyst is reduced to change the noble metals on the catalyst to an elemental state through contact with a hydrogen-rich reduction gas before being used for catalytic purposes. Although reduction of the oxidized catalyst is an essential step in most reforming operations, the step is usually performed just ahead or within the reaction zone and is not generally considered a part of the apparatus within the regeneration zone. Reduction of the highly oxidized catalyst with a relatively pure hydrogen reduction gas at a temperature of about 450–550° C., preferably about 480–510° C., to provide a reconditioned catalyst.

During lined-out operation of the continuous-reforming zone, most of the catalyst supplied to the zone is a first reforming catalyst which has been regenerated and reconditioned as described above. A portion of the catalyst to the reforming zone may be first reforming catalyst supplied as makeup to overcome losses to deactivation and fines, particularly during reforming-process startup, but these quantities are small, usually less than about 0.1%, per regeneration cycle. The first reforming catalyst is a dual-function composite containing a metallic hydrogenation-dehydrogenation, preferably a platinum-group metal component, on a refractory support which preferably is an inorganic oxide which provides acid sites for cracking and isomerization. The first reforming catalyst effects dehydrogenation of naphthenes contained in the feedstock as well as isomerization, cracking and dehydrocyclization.

The refractory support of the first reforming catalyst should be a porous, adsorptive, high-surface-area material which is uniform in composition without composition gradients of the species inherent to its composition. Within the scope of the present invention are refractory support containing one or more of: (1) refractory inorganic oxides such as alumina, silica, titania, magnesia, zirconia, chromia, thoria, boria or mixtures thereof; (2) synthetically prepared or naturally occurring clays and silicates, which may be acid-treated; (3) crystalline zeolitic aluminosilicates, either naturally occurring or synthetically prepared such as FAU, MEL, MFI, MOR, MTW (IUPAC Commission on Zeolite Nomenclature), in hydrogen form or in a form which has been exchanged with metal cations; (4) spinels such as $MgAl_2O_4$, $FeAl_2O_4$, $ZnAl_2O_4$, $CaAl_2O_4$; and (5) combinations of materials from one or more of these groups. The preferred refractory support for the first reforming catalyst is alumina, with gamma- or eta-alumina being particularly preferred.

The alumina powder may be formed into any shape or form of carrier material known to those skilled in the art such as spheres, extrudates, rods, pills, pellets, tablets or granules. Spherical particles may be formed by converting the alumina powder into alumina sol by reaction with suitable peptizing acid and water and dropping a mixture of the resulting sol and gelling agent into an oil bath to form spherical particles of an alumina gel, followed by known aging, drying and calcination steps. The extrudate form is preferably prepared by mixing the alumina powder with water and suitable peptizing agents, such as nitric acid, acetic acid, aluminum nitrate and like materials, to form an extrudable dough having a loss on ignition (LOI) at 500° C. of about 45 to 65 mass %. The resulting dough is extruded through a suitably shaped and sized die to form extrudate particles, which are dried and calcined by known methods. Alternatively, spherical particles can be formed from the extrudates by rolling the extrudate particles on a spinning disk.

The particles are usually spheroidal and have a diameter of from about 1/16th to about 1/8th inch (1.5–3.1 mm), though they may be as large as 1/4th inch (6.35 mm). In a particular regenerator, however, it is desirable to use catalyst particles which fall in a relatively narrow size range. A preferred catalyst particle diameter is 1/16th inch (3.1 mm).

An essential component of the first reforming catalyst is one or more platinum-group metals, with a platinum component being preferred. The platinum may exist within the catalyst as a compound such as the oxide, sulfide, halide, or oxyhalide, in chemical combination with one or more other ingredients of the catalytic composite, or as an elemental metal. Best results are obtained when substantially all of the platinum exists in the catalytic composite in a reduced state. The platinum component generally comprises from about 0.01 to 2 mass % of the catalytic composite, preferably 0.05 to 1 mass %, calculated on an elemental basis.

It is within the scope of the present invention that the first reforming catalyst contains a metal promoter to modify the effect of the preferred platinum component. Such metal modifiers may include Group IVA (14) metals, other Group VIII (8–10) metals, rhenium, indium, gallium, zinc, uranium, dysprosium, thallium and mixtures thereof. Excellent results are obtained when the first reforming catalyst contains a tin component. Catalytically effective amounts of such metal modifiers may be incorporated into the catalyst by any means known in the art.

The first reforming catalyst may contain a halogen component. The halogen component may be either fluorine, chlorine, bromine or iodine or mixtures thereof. Chlorine is the preferred halogen component. The halogen component is generally present in a combined state with the inorganic-oxide support. The halogen component is preferably well dispersed throughout the catalyst and may comprise from more than 0.2 to about 15 wt. %. calculated on an elemental basis, of the final catalyst.

An optional ingredient of the first reforming catalyst is a zeolite, or crystalline aluminosilicate. Preferably, however, this catalyst contains substantially no zeolite component. The first reforming catalyst may contain a non-zeolitic molecular sieve, as disclosed in U.S. Pat. No. 4,741,820 which is incorporated herein in by reference thereto.

The first reforming catalyst generally will be dried at a temperature of from about 100° to 320° C. for about 0.5 to 24 hours, followed by oxidation at a temperature of about 300° to 550° C. in an air atmosphere for 0.5 to 10 hours. Preferably the oxidized catalyst is subjected to a substantially waterfree reduction step at a temperature of about 300° to 550° C. for 0.5 to 10 hours or more. Further details of the preparation and activation of embodiments of the first reforming catalyst are disclosed in U.S. Pat. No. 4,677,094 (Moser et al.), which is incorporated into this specification by reference thereto.

The zeolitic catalyst is contained in a fixed-bed reactor or in a moving-bed reactor whereby catalyst may be continuously withdrawn and added. These alternatives are associated with catalyst-regeneration options known to those of ordinary skill in the art, such as: (1) a semiregenerative unit containing fixed-bed reactors maintains operating severity by increasing temperature, eventually shutting the unit down for catalyst regeneration and reactivation; (2) a swing-reactor unit, in which individual fixed-bed reactors are serially isolated by manifolding arrangements as the catalyst become deactivated and the catalyst in the isolated reactor is regenerated and reactivated while the other reactors remain on-stream; (3) continuous regeneration of catalyst withdrawn from a moving-bed reactor, with reactivation and substitution of the reactivated catalyst as described hereinabove; or: (4) a hybrid system with semiregenerative and continuous-regeneration provisions in the same zone. The preferred embodiment of the present invention is a hybrid system of a fixed-bed reactor in a semiregenerative zeolitic-reforming zone and a moving-bed reactor with continuous catalyst regeneration in the continuous-reforming zone.

The first reforming catalyst preferably represents about 20% to 99% by volume of the total catalyst in the present reforming process. The relative volumes of first and zeolitic reforming catalyst depend on product objectives as well as whether the process incorporates previously utilized equipment. If the product objective of an all-new process unit is maximum practical production of benzene and toluene from a relatively light hydrocarbon feedstock, the zeolitic reforming catalyst advantageously comprises a substantial proportion, preferably about 10–60%, of the total catalyst. If a new zeolitic-reforming zone is added to an existing continuous-reforming zone, on the other hand, the zeolitic reforming catalyst optimally comprises a relatively small proportion of the total catalyst in order to minimize the impact of the new section on the existing continuous-reforming operation. In the latter case, preferably about 55% to 95% of the total catalyst volume of the process is represented by the first reforming catalyst.

The addition of a zeolitic-reforming zone to an existing continuous-reforming zone, i.e., an installation in which the major equipment for a moving-bed reforming unit with continuous catalyst regeneration is in place, is a particularly advantageous embodiment of the present invention. A continuous-regeneration reforming unit is relatively capital-intensive, generally being oriented to high-severity reforming and including the additional equipment for continuous catalyst regeneration. By adding on a zeolitic-reforming zone which is particularly effective in converting light paraffins from an first effluent produced by continuous reforming, some options would be open for improvement of the overall catalytic-reforming operation:

Increase severity, in terms of overall aromatics yields or product octane number.

Increase throughput of the continuous-reforming zone by at least about 5%, preferably at least about 10%, optionally at least 20%, and in some embodiments 30% or more through reduced continuous-reforming severity. Such reduced severity would be effected by one or more of operating at higher space velocity, lower hydrogen-to-hydrocarbon ratio and lower catalyst circulation in the continuous-reforming zone. The required product quality then would be effected by processing the first effluent from the continuous-reforming zone in the zeolitic-reforming zone.

Increase selectivity, reducing severity of the continuous-reforming operation and selectively converting residual paraffins in the first effluent to aromatics.

The first effluent from the continuous-reforming zone passes to a zeolitic-reforming zone for completion of the reforming reactions. Preferably free hydrogen accompanying the first effluent is not separated prior to the processing of the first effluent in the zeolitic-reforming zone, i.e., the continuous- and zeolitic-reforming zones are within the same hydrogen circuit. It is within the scope of the invention that a supplementary naphtha feed is added to the first effluent as feed to the zeolitic-reforming zone to obtain a supplementary reformate product. The supplementary naphtha feed has characteristics within the scope of those described for the hydrocarbon feedstock, but optimally is lower-boiling and thus more favorable for production of lighter aromatics than the feed to the continuous-reforming zone. The first effluent, and optionally the supplementary naphtha feed, contact a zeolitic reforming catalyst at second reforming conditions in the zeolitic-reforming zone.

The hydrocarbon feedstock contacts the zeolitic reforming catalyst in the zeolitic-reforming zone to obtain an aromatics-rich product, with a principal reaction being dehydrocyclization of paraffinic hydrocarbons remaining in the first effluent. Second reforming conditions used in the zeolitic-reforming zone of the present invention include a pressure of from about 100 kPa to 6 MPa (absolute), with the preferred range being from 100 kPa to 1 MPa (absolute) and a pressure of about 450 kPa or less at the exit of the last reactor being especially preferred. Free hydrogen is supplied to the zeolitic-reforming zone in an amount sufficient to correspond to a ratio of from about 0.1 to 10 moles of hydrogen per mole of hydrocarbon feedstock, with the ratio preferably being no more than about 6 and more preferably no more than about 5. By "free hydrogen" is meant molecular $H_g$, not combined in hydrocarbons or other compounds. The volume of the contained zeolitic reforming catalyst corresponds to a liquid hourly space velocity of from about 1 to 40 $hr^{-1}$, value of preferably at least about 7 $hr^{-1}$ and optionally about 10 $hr^{-1}$ or more.

The operating temperature, defined as the maximum temperature of the combined hydrocarbon feedstock, free hydrogen, and any components accompanying the free hydrogen, generally is in the range of 260° to 560° C. This temperature is selected to achieve optimum overall results from the combination of the continuous- and zeolitic-reforming zones with respect to yields of aromatics in the product, when chemical aromatics production is the objective, or properties such as octane number when gasoline is the objective. Hydrocarbon types in the feed stock also influence temperature selection, as the zeolitic reforming catalyst is particularly effective for dehydrocyclization of light paraffins. Naphthenes generally are dehydrogenated to a large extent in the prior continuous-reforming reactor with a concomitant decline in temperature across the catalyst bed due to the endothermic heat of reaction. Initial reaction temperature generally is slowly increased during each period of operation to compensate for the inevitable catalyst deactivation. The temperature to the reactors of the continuous- and zeolitic-reforming zones optimally are staggered, i.e., differ between reactors, in order to achieve product objectives with respect to such variables as ratios of the different aromatics and concentration of nonaromatics. Usually the maximum temperature in the zeolitic-reforming zone is lower than that in the zeolitic-reforming zone, but the temperature in the zeolitic-reforming zone may be higher depending on catalyst condition and product objectives.

The zeolitic-reforming zone may comprises a single reactor containing the zeolitic reforming catalyst or, alternatively, two or more parallel reactors with valving as known in the art to permit alternative cyclic regeneration. The choice between a single reactor and parallel cyclic reactors depends inter alia on the reactor volume and the need to maintain a high degree of yield consistency without interruption; preferably, in any case, the reactors of the zeolitic reforming zone are valved for removal from the process combination so that the zeolitic reforming catalyst may be regenerated or replaced while the continuous reforming zone remains in operation.

In an alternative embodiment, it is within the ambit of the invention that the zeolitic-reforming zone comprises two or more reactors with interheating between reactors to raise the temperature and maintain dehydrocyclization conditions. This may be advantageous since a major reaction occurring in the zeolitic-reforming zone is the dehydrocyclization of paraffins to aromatics along with the usual dehydrogenation of naphthenes, and the resulting endothermic heat of reaction may cool the reactants below the temperature at which reforming takes place before sufficient dehydrocyclization has occurred.

In another alternative embodiment, reforming temperature may be maintained within the zeolitic-reforming zone by inclusion of heat-exchange internals in a reactor of the zone. U.S. Pat. No. 4,810,472, for example, teaches a bayonet-tube arrangement for externally heating a reformer feed that passes through catalyst on the inside of the bayonet tube. U.S. Pat. No. 4,743,432 discloses a reactor having catalyst for the production of methanol disposed in beds with cooling tubes passing through the beds for removal of heat. U.S. Pat. No. 4,820,495 depicts an ammonia- or ether-synthesis reactor having elongate compartments alternatively containing catalyst with reactants and a heat carrier fluid. Preferably a heat-exchange reactor is a radial-flow arrangement with flow channels in the form of sectors which are contained in an annular volume of the reactor; a heat-exchange medium and reactants contacting catalyst flow radially through alternate channels, optimally in a counter-current arrangement. An arrangement of webs supports thin-wall heat-exchange plates and provides flow-distribution and -collection chambers on the inner and outer periphery of the channels.

The zeolitic reforming catalyst contains a non-acidic zeolite, an alkali-metal component and a platinum-group metal component. It is essential that the zeolite, which preferably is LTL or L-zeolite, be non-acidic since acidity in the zeolite lowers the selectivity to aromatics of the finished catalyst. In order to be "non-acidic," the zeolite has substantially all of its cationic exchange sites occupied by nonhydrogen species. Preferably the cations occupying the exchangeable cation sites will comprise one or more of the alkali metals, although other cationic species may be present. An especially preferred nonacidic L-zeolite is potassium-form L-zeolite.

Generally the L-zeolite is composited with a binder in order to provide a convenient form for use in the catalyst of the present invention. The art teaches that any refractory inorganic oxide binder is suitable. One or more of silica, alumina or magnesia are preferred binder materials of the present invention. Amorphous silica is especially preferred, and excellent results are obtained when using a synthetic white silica powder precipitated as ultra-fine spherical particles from a water solution. The silica binder preferably is nonacidic, contains less than 0.3 mass % sulfate salts, and has a BET surface area of from about 120 to 160 $m^2/g$.

The L-zeolite and binder may be composited to form the desired catalyst shape by any method known in the art. For example, potassium-form L-zeolite and amorphous silica may be commingled as a uniform powder blend prior to introduction of a peptizing agent. An aqueous solution comprising sodium hydroxide is added to form an extrudable dough. The dough preferably will have a moisture content of from 30 to 50 mass % in order to form extrudates having acceptable integrity to withstand direct calcination. The resulting dough is extruded through a suitably shaped and sized die to form extrudate particles, which are dried and calcined by known methods. Alternatively, spherical particles may be formed by methods described hereinabove for the zeolitic reforming catalyst.

An alkali-metal component is an essential constituent of the zeolitic reforming catalyst. One or more of the alkali metals, including lithium, sodium, potassium, rubidium, cesium and mixtures thereof, may be used, with potassium being preferred. The alkali metal optimally will occupy essentially all of the cationic exchangeable sites of the non-acidic L-zeolite. Surface-deposited alkali metal also may be present as described in U.S. Pat. No. 4,619,906, incorporated herein in by reference thereto.

A platinum-group metal component is another essential feature of the zeolitic reforming catalyst, with a platinum component being preferred. The platinum may exist within the catalyst as a compound such as the oxide, sulfide, halide, or oxyhalide, in chemical combination with one or more other ingredients of the catalytic composite, or as an elemental metal. Best results are obtained when substantially all of the platinum exists in the catalytic composite in a reduced state. The platinum component generally comprises from about 0.05 to 5 mass % of the catalytic composite, preferably 0.05 to 2 mass %, calculated on an elemental basis. It is within the scope of the present invention that the catalyst may contain other metal components known to modify the effect of the preferred platinum component. Such metal modifiers may include Group IVA(14) metals, other Group VIII(8–10) metals, rhenium, indium, gallium, zinc, uranium, dysprosium, thallium and mixtures thereof. Catalytically effective amounts of such metal modifiers may be incorporated into the catalyst by any means known in the art.

The final zeolitic reforming catalyst generally will be dried at a temperature of from about 100° to 320° C. for about 0.5 to 24 hours, followed by oxidation at a temperature of about 300° to 550° C. (preferably about 350° C.) in an air atmosphere for 0.5 to 10 hours. Preferably the oxidized catalyst is subjected to a substantially water-free reduction step at a temperature of about 300° to 550° C. (preferably about 350° C.) for 0.5 to 10 hours or more. The duration of the reduction step should be only as long as necessary to reduce the platinum, in order to avoid pre-deactivation of the catalyst, and may be performed in-situ as part of the plant startup if a dry atmosphere is maintained. Further details of the preparation and activation of embodiments of the zeolitic reforming catalyst are disclosed, e.g., in U.S. Pat. Nos. 4,619,906 (Lambert et al) and 4,822,762 (Ellig et al.), which are incorporated into this specification by reference thereto.

The zeolitic-reforming zone produces an aromatics-rich product contained in a reformed effluent containing hydrogen and light hydrocarbons. Using techniques and equipment known in the art, the reformed effluent from the zeolitic-reforming zone usually is passed through a cooling zone to a separation zone. In the separation zone, typically maintained at about 0° to 65° C., a hydrogen-rich gas is separated from a liquid phase. Most of the resultant hydrogen-rich stream optimally is recycled through suitable compressing means back to the zeolitic-reforming zone, with a portion of the hydrogen being available as a net product for use in other sections of a petroleum refinery or chemical plant. The liquid phase from the separation zone is normally withdrawn and processed in a fractionating system in order to adjust the concentration of light hydrocarbons and to obtain the aromatics-rich product.

It is within the scope of the invention that the order of the continuous-reforming zone and the zeolitic-reforming zone is reversed, i.e., an alternative embodiment is reforming of a hydrocarbon feedstock with a zeolitic catalyst to obtain an aromatized effluent which is processed in a moving-bed reforming unit with continuous catalyst regeneration to obtain an aromatics-rich product. Operating conditions and catalysts for the two zones are within the parameters described above. This embodiment may be termed pre-aromatization of a continuous-reforming feedstock, in which the zeolitic-reforming zone effects dehydrocyclization of paraffins prior to high-severity reforming with continuous catalyst regeneration.

EXAMPLES

The following examples are presented to demonstrate the present invention and to illustrate certain specific embodiments thereof. These examples should not be construed to limit the scope of the invention as set forth in the claims. There are many possible other variations, as those of ordinary skill in the art will recognize, which are within the spirit of the invention.

Three parameters are especially useful in evaluating reforming process and catalyst performance, particularly in evaluating catalysts for dehydrocyclization of paraffins. "Activity" is a measure of the catalyst's ability to convert reactants at a specified set of reaction conditions. "Selectivity" is an indication of the catalyst's ability to produce a high yield of the desired product. "Stability" is a measure of the catalyst's ability to maintain its activity and selectivity over time.

The examples present comparative results of pilot-plant tests when processing a naphtha feedstock comprising principally $C_6$–$C_8$ hydrocarbons. The naphtha feedstock had the following characteristics:

| | |
|---|---|
| Sp. gr. | 0.7283 |
| ASTM D-86, ° C.: | |
| IBP | 75 |
| 50% | 100 |
| EP | 137 |
| Volume % | |
| Paraffins | 62.0 |
| Naphthenes | 28.5 |
| Aromatics | 9.5 |

The comparative tests were effected over a range of conversions of non-aromatics in the feedstock at corresponding conditions, comparing results from the multi-zone process combination of the invention with those from known, closely related reforming processes. Results are evaluated on the basis of the yields of "BTX aromatics," or benzene/toluene/xylene/ethylbenzene, representing the basic aromatic intermediates, and "$C_8$ aromatics," or xylenes+ ethylbenzene, generally considered the target aromatic intermediate on which modern aromatics complexes are sized.

Example I

Reforming pilot-plant tests were performed based on the known use of a Catalyst A, a continuously regenerable catalyst comprising 0.29 mass-% platinum and 0.30 mass-% tin on chlorided alumina, to process the $C_6$–$C_8$ feedstock described hereinabove. Operating pressure was about 450 kPa, liquid hourly space velocity was about 2.5 $hr^{-1}$ and molecular hydrogen was supplied at a molar ratio to the feedstock of about 6. Temperature was varied to obtain conversion of nonaromatic hydrocarbons in the range of 45 to 77 mass %. BTX aromatics yields over the range of conversion for this control example are plotted in FIG. 1.

Example II

Reforming pilot-plant tests were performed based on the multi-zone process combination of the invention processing the $C_6$–$C_8$ feedstock described hereinabove. Catalyst A was as described in Example I, and was loaded in front of a Catalyst B comprising 0.82 mass-% platinum on silica-bound L-zeolite. The volumetric ratio of Catalyst A to Catalyst B was 75/25.

The naphtha was charged to the reactor in a downflow operation, thus contacting Catalysts A and B successively. Operating pressure was about 450 kPa, overall liquid hourly space velocity with respect to the combination of catalysts was about 2.5 $hr^{-1}$, and hydrogen was supplied at a molar ratio to the feedstock of about 4.5. Temperature was varied to obtain about 50 to 87 mass % conversion of nonaromatic hydrocarbons.

The results are plotted in FIG. 1 in comparison to the results of using Catalyst A only according to control Example I. The catalyst combination showed a significant aromatics-yield increase over results based on control Catalyst A.

Example III

The yield structures of the control Catalyst A and the combination Catalyst A/B of the invention were compared at an equivalent conversion of 74% of the nonaromatics in the feedstock (respectively about 99.5 and 98.5 Research Octane of the $C_5$+ product), selected from the range of conversions in Examples I and II and expressed as mass-% yield relative to the feedstock:

| | Catalyst A | Catalysts A/B |
|---|---|---|
| Benzene | 9.5 | 13.0 |
| Toluene | 25.0 | 31.0 |
| $C_8$ aromatics | 25.0 | 22.0 |
| Total BTX aromatics | 59.5 | 66.0 |
| Hydrogen | 3.6 | 4.0 |
| $C_5$+ product | 89.4 | 91.2 |

The catalyst combination of the invention demonstrated over 10% higher aromatics yields relative to the control, as well as higher hydrogen and higher $C_5$+ yields.

Example IV

Another advantage of the process combination of the invention may be realized through more effective utilization of the continuous-reforming zone by shifting the final portion of the reaction to a zeolitic-reforming zone. This advantage would be particularly significant in the situation of an existing continuous-reforming zone with continuous catalyst regeneration which cannot meet increasing needs for gasoline or aromatics. Through the present invention, feedstock throughput is increased in this zone along with a reduction in conversion without increasing catalyst circulation rate and regeneration rate. Overall conversion in the combination is maintained by adding substantially only a reactor in a zeolitic-reforming zone contained in the same hydrogen circuit while achieving higher throughput.

This embodiment can be illustrated by an example derived from the pilot-plant tests described hereinabove, comparing an "original" case with only a continuous-reforming zone and a case of the invention in which a zeolitic-reforming zone is added in order to increase the throughput of a process unit from an original value of 1,000,000 metric tons per year:

| | Original | Invention |
|---|---|---|
| Throughput, $10^3$ tons/year | 1,000 | 1,300 |
| Conversion of nonaromatics, mass-%* | 74 | 65 |
| Catalyst circulation | base | 0.9× base |
| Hydrogen/feedstock, mole | 6.0 | 4.5 |
| Liquid hourly space velocity, $hr^{1}$* | 2.5 | 3.3 |
| Yields, $10^3$ tons/year: | | |
| $C_5$+ product | 894 | 1,185 |
| Benzene | 95 | 169 |
| Toluene | 250 | 403 |
| $C_8$ aromatics | 250 | 286 |
| Total BTX aromatics | 595 | 858 |

*in continuous-reforming zone

Space velocity in the zeolitic-reforming zone is set at 10 $hr^{-1}$. Catalyst volume and gas circulation usually are the limiting parameters in the throughput of a hydroprocessing unit; liquid throughput often can be increased by 20–30% or more with little or no hydraulic debottlenecking. Thus addition of a zeolitic-reforming zone comprising a reactor containing a non-acidic zeolite catalyst with possible minor modifications to other equipment results in an increase in BTX aromatics production of about 44% according to the above example illustrating the present invention.

Example V

A second set of control reforming pilot-plant tests were performed based on the known use of the aforementioned Catalysts A and B to process the $C_6$–$C_8$ feedstock described hereinabove. Operating pressure was about 450 kPa and hydrogen was supplied at a molar ratio to the feedstock of about 6. Temperature was varied to obtain conversion of nonaromatic hydrocarbons in the range of 64 to 77 mass % for Catalyst A and 64 to 78 mass-% for Catalyst B. The results are plotted in FIG. 2.

Example VI

An example of the reverse order of the preferred embodiment of the invention, which also is within the ambit of the invention, was tested in a pilot-plant operation. The naphtha was charged to the reactor in a downflow operation, contacting Catalysts B and A successively. Operating pressure was about 450 kPa and hydrogen was supplied to the reactor to provide a molar ratio to the feedstock of about 6. Temperature was varied to obtain conversion of nonaromatic hydrocarbons in the range of 72 to 77 mass %.

Figure 2:
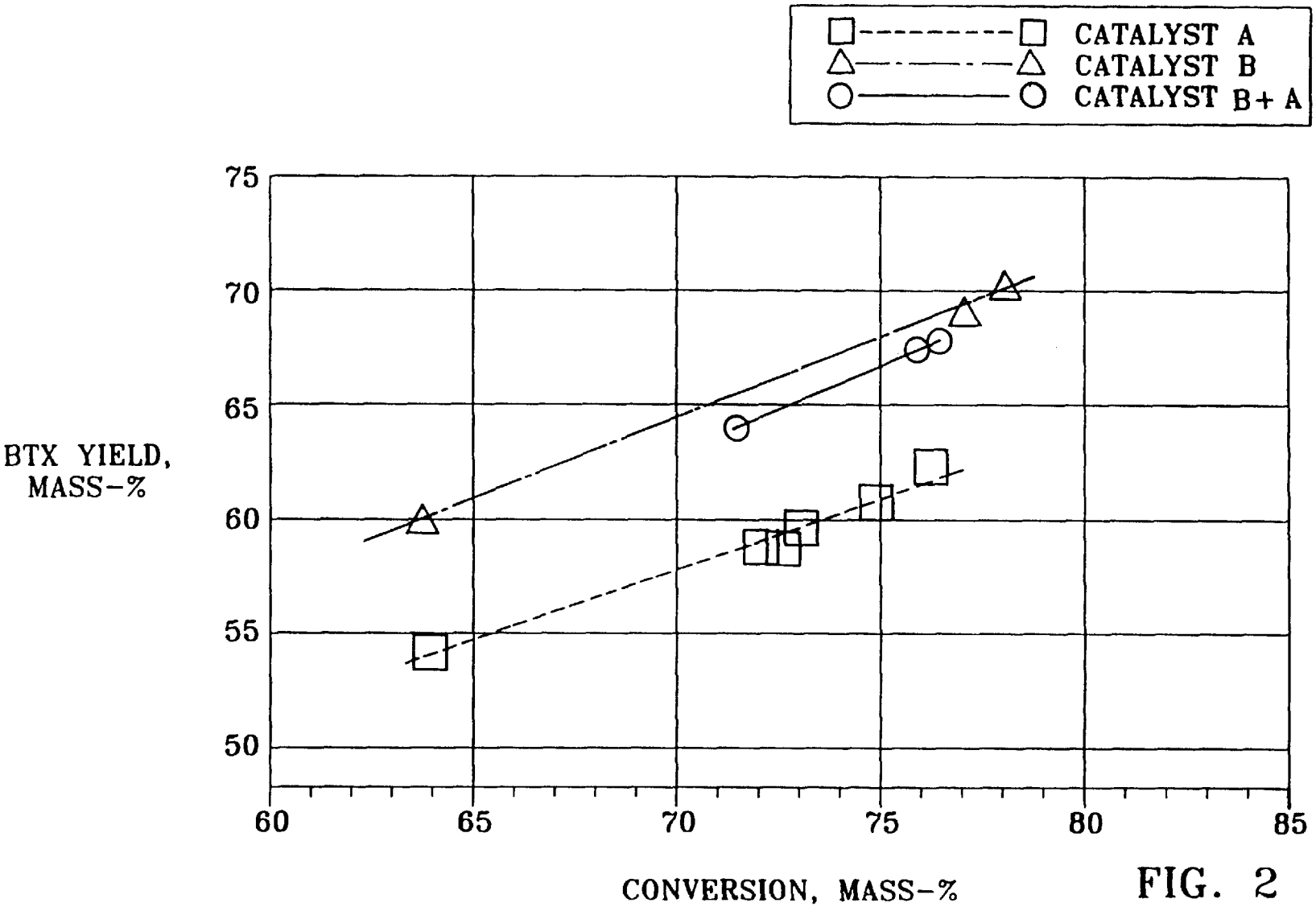
FIG. 2 compares BTX-aromatics yields for an embodiment of the invention comprising a zeolitic-reforming zone as a lead zone to yields from prior-art processes.

The results are plotted in FIG. 2 in comparison to the control results as described in Example V. The catalyst combination showed a significant aromatics-yield increase relative to Catalyst A, comparable to Catalyst B.

Example VII

The operating temperature of the Example VI process combination of the invention was staggered to optimize the environment of each catalyst. The temperature to the zone containing Catalyst B was raised to 515° C. while the temperature to Catalyst A was maintained at 493° C. Results were assessed on the basis of the Research octane number (RON) of the product from each of the staggered-temperature operation and the constant-temperature operation of Example VI:

Staggered temperature 99.8 RON

Constant temperature 97.4 RON

Example VIII

Results from the three pilot-plant runs presented in Examples V and VI were compared with respect to yields of the desired BTX and $C_8$-aromatics products:

| | Catalysts B/A (Invention) | Catalyst B (Known) | Catalyst A (Known) |
|---|---|---|---|
| BTX aromatics, mass % | 67 | 68 | 61 |
| $C_8$ aromatics % | 23 | 17.5 | 25 |

The reverse process combination of the invention yields substantially more $C_8$ aromatics than known Catalyst A with only a small sacrifice in overall BTX aromatics and substantially more BTX than Catalyst B with a relatively small reduction in $C_8$ aromatics.

We claim:

1. In a process for catalytically reforming a hydrocarbon feedstock distilling substantially within the range of 40° and 210° C. comprising contacting the hydrocarbon feedstock in the presence of free hydrogen in a continuous-reforming zone with reconditioned bifunctional reforming catalyst particles comprising a platinum-group metal component, a halogen component and a refractory inorganic oxide at first reforming conditions comprising a pressure of from about 100 kPa to 1 MPa, liquid hourly space velocity of from about 0.2 to 10 $hr^{-1}$, mole ratio of hydrogen to $C_5$+ hydrocarbons of about 0.1 to 10, and temperature of from about 400° to 560° C. to produce an original first effluent containing BTX aromatics and a base amount of deactivated catalyst particles, removing the deactivated catalyst particles at least semicontinuously from the continuous-reforming zone and contacting at least a portion of the particles sequentially in a continuous-regeneration zone with an oxygen-containing gas and in a reduction zone with a hydrogen-containing gas to obtain reconditioned catalyst particles, the improvement comprising increasing the throughput of the continuous-reforming zone by at least about 5 volume-% with a concomitant increase in space velocity and decrease in hydrogen-to-hydrocarbon mole ratio in the range of about 0.1 to 6 with no increase in the amount of deactivated catalyst particles over the base amount to obtain an aromatics-rich product containing at least about 10% more BTX aromatics than the original first effluent by contacting the naphtha feedstock prior to the first reforming zone in a zeolitic-reforming zone with a zeolitic reforming catalyst comprising a non-acidic zeolite, an alkali metal component and a platinum-group metal component at second reforming conditions comprising a pressure of from about 100 kPa to 6 MPa, a liquid hourly space velocity of from about 1 to 40 $hr^{-1}$ and a temperature of from about 260° to 560° C. to obtain an aromatized effluent as feed to the continuous-reforming zone.

2. The process of claim 1 wherein the pressure in each of the continuous-reforming zone and zeolitic reforming zone is between about 100 kPa and 1 MPa.

3. The process of claim 1 wherein the pressure in each of the continuous-reforming zone and zeolitic reforming zone is about 450 kPa or less.

4. The process of claim 1 wherein the hydrogen-to-hydrocarbon mole ratio in the continuous-reforming zone to obtain the aromatics-rich product is no more than about 5.

5. The process of claim 1 wherein the liquid hourly space velocity of the zeolitic reforming zone is at least about 7 $hr^{-1}$.

6. The process of claim 1 wherein the liquid hourly space velocity of the zeolitic reforming zone is at least about 10 $hr^{-1}$.

7. The process of claim 1 wherein the platinum-group metal component of the reconditioned reforming catalyst comprises a platinum component.

8. The process of claim 1 wherein the refractory inorganic oxide of the reconditioned reforming catalyst comprises alumina.

9. The process of claim 1 wherein the reconditioned reforming catalyst further comprises a metal promoter consisting of one or more of the Group IVA (14) metals, rhenium, indium or mixtures thereof.

10. The process of claim 1 wherein the nonacidic zeolite comprises potassium-form L-zeolite.

11. The process of claim 1 wherein the alkali-metal component comprises a potassium component.

12. The process of claim 1 wherein the platinum-group metal component of the zeolitic reforming catalyst comprises a platinum component.

13. In a process for catalytically reforming a hydrocarbon feedstock distilling substantially within the range of 40° and 210° C. comprising contacting the hydrocarbon feedstock in the presence of free hydrogen in a continuous-reforming zone with reconditioned bifunctional reforming catalyst particles comprising a platinum-group metal component, a halogen component and a refractory inorganic oxide at first reforming conditions comprising a pressure of from about 100 kPa to 1 MPa, liquid hourly space velocity of from about 0.2 to 10 $hr^{-1}$, mole ratio of hydrogen to $C_5$+ hydrocarbons of about 0.1 to 10, and temperature of from about 400° to 560° C. to produce an original first effluent containing BTX aromatics and a base amount of deactivated catalyst particles, removing the deactivated catalyst particles at least semicontinuously from the continuous-reforming zone and contacting at least a portion of the particles sequentially in a continuous-regeneration zone with an oxygen-containing gas and in a reduction zone with a hydrogen-containing gas to obtain reconditioned catalyst particles, the improvement comprising increasing the throughput of the continuous-reforming zone by at least about 5 volume-% with a concomitant increase in space velocity and decrease in hydrogen-to-hydrocarbon mole ratio in the range of about 0.1 to 6 with no increase in the amount of deactivated catalyst particles over the base amount to obtain an aromatics-rich product containing at least about 10% more BTX aromatics than the original first effluent by contacting the hydrocarbon feedstock prior to the first reforming zone in a zeolitic-reforming zone with a zeolitic reforming catalyst comprising a non-acidic zeolite, an alkali metal component and a platinum-group metal component at second reforming conditions comprising a pressure of from about 100 kPa to 6 MPa, a liquid hourly space velocity of from about 7 to 40 $hr^{-1}$ and a temperature of from about 260° to 560° C. to obtain an aromatized effluent as feed to the continuous-reforming zone.

14. The process of claim 13 wherein the regenerated catalyst particles are subjected to a redispersion step using a chlorine-containing gas at about 425° to 600° C. to redisperse the platinum-group metal on the catalyst particles and obtain redispersed catalyst particles which are contacted in the reduction zone.

15. In a process for catalytically reforming a hydrocarbon feedstock distilling substantially within the range of 40° and 210° C. comprising contacting the hydrocarbon feedstock in the presence of free hydrogen in a continuous-reforming zone with reconditioned bifunctional reforming catalyst particles comprising a platinum-group metal component, a halogen component and a refractory inorganic oxide at first reforming conditions comprising a pressure of from about 100 to 450 kPa, liquid hourly space velocity of from about 0.2 to 10 $hr^{-1}$, mole ratio of hydrogen to $C_5$+ hydrocarbons of about 0.1 to 10, and temperature of from about 400° to 560° C. to produce an original first effluent containing BTX aromatics and a base amount of deactivated catalyst particles, removing the deactivated catalyst particles at least semicontinuously from the continuous-reforming zone and contacting at least a portion of the particles sequentially in a continuous-regeneration zone with an oxygen-containing gas, in a redispersion zone with a chlorine-containing gas and in a reduction zone with a hydrogen-containing gas to obtain reconditioned catalyst particles, the improvement comprising increasing the throughput of the continuous-reforming zone by at least about 5 volume-% with a concomitant increase in space velocity and decrease in hydrogen-to-hydrocarbon mole ratio in the range of about 0.1 to 6 with no increase in the amount of deactivated catalyst particles over the base amount to obtain an aromatics-rich product containing at least about 10% more BTX aromatics than the original first effluent by contacting the hydrocarbon feedstock prior to the first reforming zone in a zeolitic-reforming zone with a zeolitic reforming catalyst comprising a non-acidic zeolite, an alkali metal component and a platinum-group metal component at second reforming conditions comprising a pressure of from about 100 to 450 kPa, a liquid hourly space velocity of from about 7 to 40 $hr^{-1}$ and a temperature of from about 260° to 560° C. to obtain an aromatized effluent as feed to the continuous-reforming zone.

* * * * *